United States Patent [19]

Geshner et al.

[11] 4,068,390

[45] Jan. 17, 1978

[54] PHOTOMASK DRYER

[75] Inventors: Robert Andrew Geshner, Warren, N.J.; Louis Joseph Sciambi, Philadelphia, Pa.

[73] Assignee: RCA Corporation, New York, N.Y.

[21] Appl. No.: 718,805

[22] Filed: Aug. 30, 1976

[51] Int. Cl.[2] ..... F26B 21/00

[52] U.S. Cl. ..... 34/239; 34/240; 34/DIG. 11; 219/379; 219/380

[58] Field of Search ..... 34/237–240, 34/243, DIG. 11; 432/253, 261, 5, 6, 152; 55/510, 523; 126/21 A, 21 R; 219/359, 360, 366, 367, 373, 375, 379, 380, 400, 521; 206/454–456; 211/40, 41; 98/40 C; 269/296; 118/500, 64

[56] References Cited

U.S. PATENT DOCUMENTS

| | | | |
|---|---|---|---|
| 500,634 | 7/1893 | Tymeson | 34/240 |
| 758,451 | 4/1904 | Judelson | 34/240 |
| 1,018,037 | 2/1912 | Dunham | 34/239 |
| 2,209,054 | 7/1940 | Doud et al. | 34/243 R |
| 2,598,603 | 5/1952 | Richtarsic | 55/523 |
| 2,668,368 | 2/1954 | Jacobs | 34/239 |
| 2,782,526 | 2/1957 | Cota | 34/DIG. 11 |
| 2,917,179 | 12/1959 | Casey et al. | 211/40 |
| 3,069,002 | 12/1962 | Hart | 206/455 |
| 3,206,868 | 9/1965 | Bascom | 98/40 C |
| 3,306,794 | 2/1967 | Humbert, Jr. | 55/510 |

*Primary Examiner*—John J. Camby
*Assistant Examiner*—Henry C. Yuen
*Attorney, Agent, or Firm*—H. Christoffersen; R. P. Williams; Sanford J. Asman

[57] ABSTRACT

The dryer is used for drying developed photomasks of the type used in manufacturing integrated circuit devices. The dryer provides a continuous flow of very clean, warm, dry air over photomasks placed in it to dry. The dryer comprises a box having a series of distributor tubes extending into it. Drying racks holding photomasks hang from the distributor tubes and heated, filtered air flows from at least one slot in the distributor tube over the wet photomasks to dry them.

12 Claims, 4 Drawing Figures

PHOTOMASK DRYER

The present invention relates to a dryer for use in drying developed photomasks.

Photomasks which are used in manufacturing semiconductor integrated circuits are manufactured in a photographic process which requires the same type of developing steps used to develop photographic films. Following a washing step in which the photographic chemicals are washed from the developed photomasks, they are dried. It is necessary to keep the photomasks as clean as possible at all times to prevent them from streaking or accumulating dust while they are wet. Accordingly, it is necessary to have a dryer capable of providing a flow of very clean, warm, dry air over the photomasks in order to prevent them from being contaminated in the drying step.

Figure 1:
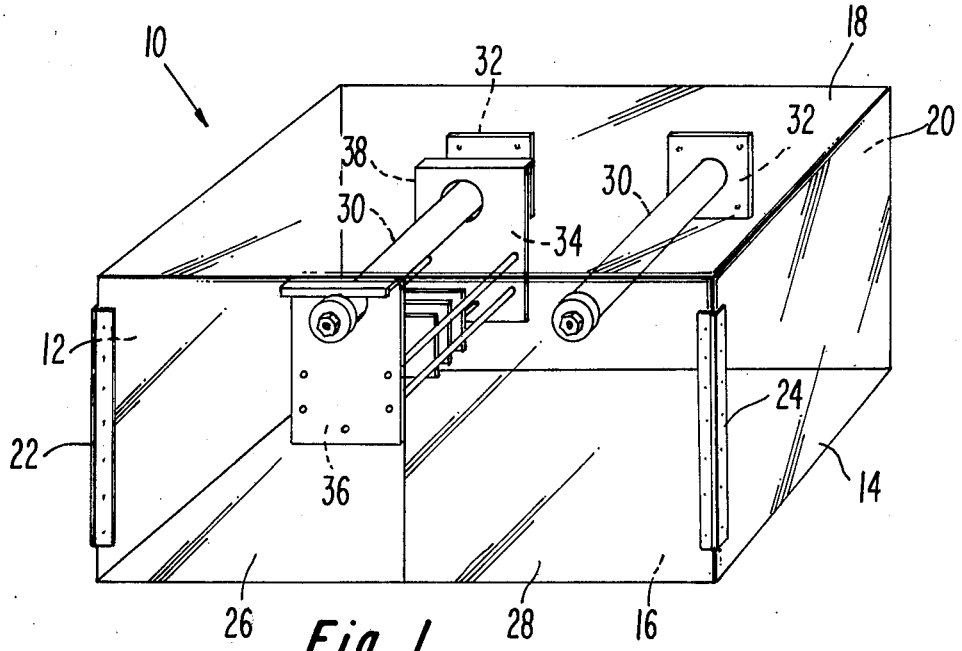
FIG. 1 is a perspective view of the front of the dryer of the present invention.

Referring generally to FIG. 1, the photomask dryer 10 of the present invention is shown. The dryer 10 is comprised of box having side walls 12, 14, a bottom wall 16, a top wall 18 and a rear wall 20. Front doors 26, 28 are attached to the side walls 12, 14 by hinges 22, 24. In the preferred embodiment of the dryer 10 the walls and doors are comprised of a clear material, such as plexiglass. Extending into the box from the rear wall 20 are a series of cylindrical distributor tubes 30. The number of distributor tubes 30 is not important to the present invention but will determine the capacity of the dryer 10.

The distributor tubes 30 are mounted through the rear wall 20 of the dryer by using flanges 32 which attach to the rear wall 20. The flanges may be attached by any desired means, such as by screws.

When photomasks are ready to be dried they are placed into a mask drying rack 34 which has a pair of opposed walls 36, 38 each of which has an opening in order to allow the rack 34 to slide over, and hang from, one of the distributor tubes 30. The distributor tubes 30 have clean, warm, dry air flowing out of a downward facing slot which extends along a portion of their length so that the air flows over photomasks held in the drying rack 34.

Figure 2:
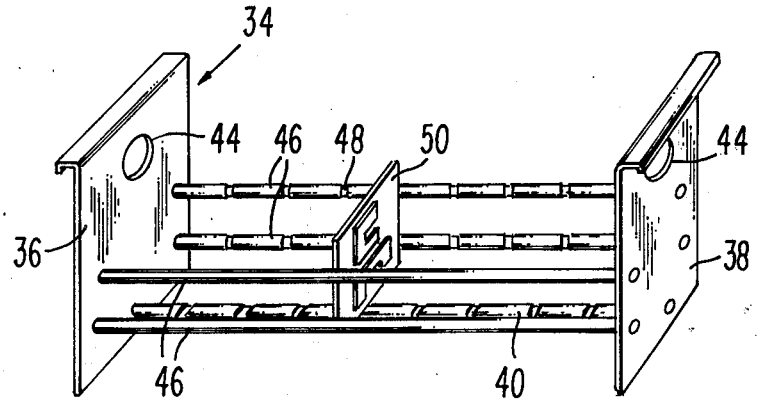
FIG. 2 is a perspective view of a drying rack employed with the dryer.

Referring now to FIG. 2, a perspective view of one of the drying racks 34 is shown. The drying rack 34 is comprised of two opposed walls 36, 38, a bottom support member 40, and side support members 46. An opening 44 is formed in each of the side walls 36, 38 to enable the drying rack 34 to be slid over a distributor tube 30. Vertical slots 48 adapted to receive photomasks, such as photomask 50, are formed in the side support members 46. The width of each drying rack 34 and its height will be determined by the size of the photomasks 50 which are to be dried in the rack 34. The length of the racks 34 and the size of the openings 44 in the walls 36, 38 are determined by the length and diameter of the distributor tubes 30.

A significant advantage of the present invention is that a number of drying racks of different sizes can be interchangeably used with the dryer 10. The racks may have different dimensions, thereby enabling a single dryer 10 to be used for drying photomasks of different sizes. In view of the fact that each of the drying racks 34 hangs down from a distributor tube 30, it is only important that the openings 44 in the side walls 36, 38 of each drying rack 34 be adapted to slide over a distributor tube 30. The width and height of different drying racks 34 can vary in size, to dry different sized photomasks.

Figure 3:
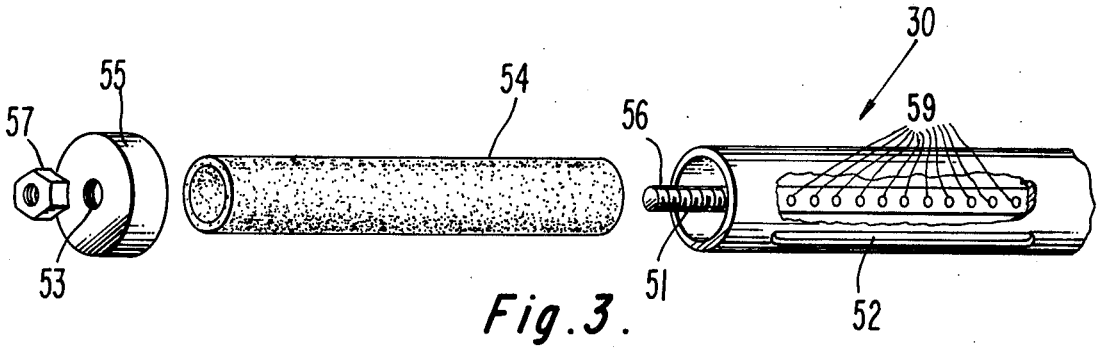
FIG. 3 is a perspective view of the bottom of a disassembled distributor tube illustrating the stone filter used for distributing and filtering air.

Referring now to FIG. 3, a bottom perspective view of a portion of a distributor tube 30 is shown in order to show the slot 52 which is formed along the bottom of the tube 30 and also to show the manner in which the tube 30 is constructed. A cylindrical stone filter 54 which is used to distribute and filter air that flows through the tube 30 and out the slot 52 slides into the tube 30. In the preferred embodiment of the invention, the stone filter 54 is a porous stone filter tube which is 17 ¼ inches long and has a 1 ½ inch outside diameter and a 1 inch inside diameter and is manufactured by the Heico Corporation located in Delaware Water Gap, Pennsylvania. The stone filter 54 surrounds a cylindrical brass rod 56 through which air flows into the tube 30. At least one hole 59 is formed along the length of the brass rod 56 to allow air to flow out of the rod 56 and through the stone filter 54.

A threaded portion 51 at the end of the brass rod 56 is adapted to be screwed through a threaded opening 53 in the end cap 55 of the distributor 30. After the stone filter 54 is inserted over the brass rod 56, the end cap 55 is threaded onto the portion 51 of the tube 56. Then a retaining nut 57 is threaded onto the exposed portion 51, thereby securing the end cap 55. The end of the brass rod 56 containing the threaded portion 51 is plugged to prevent air from flowing out of the tube 56 through the portion 51.

Figure 4:
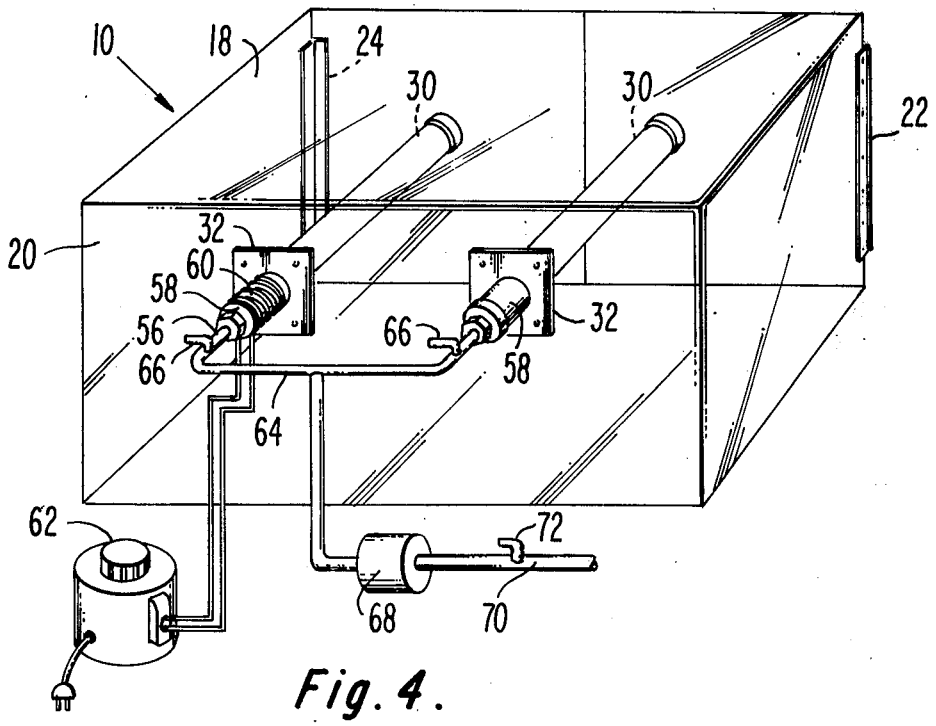
FIG. 4 is a perspective view of the rear of the dryer.

Referring now to FIG. 4, a view from the rear of the dryer 10 is shown. At the rear of each of the distributor tubes 30, behind the flange 32, there is a section 58 which extends outward from the rear wall 20 of the dryer 10. An electrically heated tape-like material 60, such as Briskeat Flexible Heating Tape, which is manufactured in one inch wide, four foot lengths by the Brisco Manufacturing Company of Columbus, Ohio, is wrapped around the section 58. One of the distributor tubes 30 is shown without the material 60 in order to illustrate the section 58. The material 60 is connected to an electrical power source such as a variable transformer 62 which can be used to vary the current through the material 10 thereby varying the amount of the heat added to the air which flows through the tube 30. At the rear of the section 58 a manifold 64 is connected to the cylindrical rods 56 which extend into the distributor tubes 30. Valves 66 are used to control the air flow into individual distributor tubes 30 from the manifold 64. Air flows into the manifold 64 through a filter 68 which is fed air from a compressor or other air supply through air line 70. In the preferred embodiment of the invention, the filter 68 is an Ultripor DFAMB42001, UR 0.35 micron filter, manufactured by the Pall Trincor Corp. of Union, New Jersey. The flow of air through the line 70 is regulated by adjusting a valve 72 in the line 70.

The dryer 10 has many advantages over the dryers previously used for dry photomasks. In particular, the air which flows through the dryer 10 may come from any air source, because the stone filters 54 absorb any oil present in the air. The stone filters 54 may be periodically cleaned in an acid, such as nitric acid.

Also, the dryer 10 uses the adiabatic principle to produce relatively dry air. That, together with the precise location of the photomasks below the slots 52 in the distributor tubes 30 insures that there will be no uneven drying of photomasks. Accordingly, water spots and reticulation of the photomask emulsion are eliminated.

What is claimed is:

1. A photomask dryer comprising:

a. an enclosed box having at least one door;

b. at least one heated air distributor tube extending into said box from a wall thereof said at least one distributor tube having at least one opening within said box through which air may pass from said at least one distributor tube downward into said box;

c. filter means positioned within said at least one distributor tube for filtering and evenly distributing said air before said air leaves said at least one distributor tube within said box;

d. means external to said box for heating said air which enters said at least one distributor tube;

e. a rack adapted to be suspended from said at least one distributor tube and adapted to hold at least one photomask under said at least one opening whereby said at least one photomask placed in said rack will be positioned for drying beneath said at least one distributor tube, said rack being completely removable from said dryer.

2. The dryer of claim 1 wherein said distributor tube comprises a cylindrical tube having at least one opening which extends along a portion of the length thereof, said portion extending into said box.

3. The dryer of claim 2 wherein said distributor tube further comprises a flange for attaching said tube to a wall of said box.

4. The dryer of claim 3 wherein a portion of said distributor tube extends out of said box and said portion has means for heating said tube associated therewith.

5. The dryer of claim 1 wherein said means for distributing and filtering air comprises a cylindrical stone filter.

6. The dryer of claim 1 wherein said rack is comprised of a pair of opposed walls each containing an opening which adapts said rack to be slid over a distributor tube and a series of support members which extend between said opposed walls.

7. The dryer of claim 6 in which said support members have slots formed therein for receiving and holding photomasks.

8. The dryer of claim 1 further comprising a manifold which connects each of said distributor tubes to an air supply.

9. The dryer of claim 8 further comprising an additional filter means between said manifold and said air supply.

10. The dryer of claim 8 wherein said means for heating is isolated from said air.

11. The dryer of claim 10 wherein said means for heating comprises electrically heated tape which is wrapped around a portion of said manifold outside of said box.

12. The dryer of claim 11 further comprising means for regulating the current flow through said tape whereby the temperature of said air may be regulated.

* * * * *